United States Patent [19]

Kelley

[11] 4,254,990

[45] Mar. 10, 1981

[54] STABILIZED OSCILLATING CHAIR

[76] Inventor: Eugene M. Kelley, 1796 Larkspur, Pomona, Calif. 91766

[21] Appl. No.: 20,051

[22] Filed: Mar. 13, 1979

[51] Int. Cl.[3] ..... A47C 1/00

[52] U.S. Cl. ..... 297/273; 297/314; 114/194

[58] Field of Search ..... 114/191–195; 244/122 R; 248/188.3; 297/273, 277, 281, 301, 302, 314, 315, 326

[56] References Cited

U.S. PATENT DOCUMENTS

| | | | |
|---|---|---|---|
| 12,703 | 4/1855 | Thomas | 297/314 X |
| 14,890 | 5/1856 | Thomas | 297/314 X |
| 179,443 | 4/1876 | Blair | 297/314 X |
| 225,006 | 3/1880 | Gardner | 114/193 |
| 667,076 | 1/1901 | Engelbrecht | 114/194 |
| 968,195 | 8/1910 | Reed | 114/194 |
| 1,689,964 | 10/1928 | Perego | 114/194 |
| 2,740,590 | 4/1956 | Roberts-Horsfield | 114/194 X |
| 3,863,587 | 2/1975 | Bosnich | 114/191 |

*Primary Examiner*—Francis K. Zugel

*Attorney, Agent, or Firm*—Boniard I. Brown

[57] ABSTRACT

A stabilized oscillating chair has a base means, a column extending upwardly from the base, a seat assembly having bottom, back and arm rest portions, and a yoke assembly supported on the upper portion of the column for roll rotation. The yoke assembly is pivotable for yaw rotation relative to the base, and extends under the arm rests for pivotal connection for pitch rotation of the chair assembly. Roll pivot means are provided between the column and the yoke assembly, and pitch pivot means are provided between the yoke assembly and the arm rests. Pitch bias springs are connected with the pitch pivots to urge the chair assembly to normal attitude and have such resilience as to accommodate maintenance of the seat assembly level when occupied. Roll bias springs are connected with the roll pivotal connection to resiliently urge the yoke assembly and chair assembly toward a normal attitude, and are adapted to maintain the chair assembly in normal attitude when unoccupied and to permit it to remain substantially level when occupied.

9 Claims, 11 Drawing Figures

STABILIZED OSCILLATING CHAIR

BACKGROUND OF THE INVENTION

Stabilizing or oscillating chairs for use on boats and other craft, have been developed and utilized for many years, and various pivotable yoke or gimbal structures have been utilized or proposed to maintain a chair occupant in a level orientation or upright during pitching and rolling of a vehicle. Nevertheless, there is substantial need for an improved chair assembly of this general type which provides compactness, simplicity, and improved stability.

The following prior art references are known to applicant:

U.S. Pat. No. 12,703 to Thomas (1855)
U.S. Pat. No. 14,890 to Thomas (1856)
U.S. Pat. No. 179,443 to Blair (1876)
U.S. Pat. No. 1,689,964 to Perego (1928)
U.S. Pat. No. 2,740,599 to Roberts-Horsfield (1956)

SUMMARY OF THE INVENTION

The present invention provides a stabilized oscillating chain structure comprising base means, a column extending upwardly from the base, a seat assembly having a bottom portion, a back portion and arm rests on either side and above the bottom portion, and a yoke assembly supported for roll rotation on the upper end portion of the column. The yoke assembly is pivotable for yaw rotation relative to the base, and extends under the arm rests with which it is pivotally connected for roll pitch rotation of the chair assembly. The yoke assembly preferably includes a U-shaped portion or member extending under the chair assembly and having arm portions thereof supporting pitch pivots for mounting the chair assembly for pitch rotation. The column preferably has a rearwardly offset upper portion of the yoke assembly. The yoke assembly preferably includes a U-shaped member or portion extending under the chair assembly seat portion and extending upwardly to carry pitch pivots mounting the chair assembly for pitch rotation, and the U-shaped member or portion is joined by interconnecting members extending upwardly to converge in a roll pivot arrangement connected with the upper portion of the column.

Opposed pitch bias springs are preferably connected with the pitch pivots to urge the chair assembly to a normal attitude, and are adapted to exert biasing force to maintain the chair assembly in normal attitude relative to the base when the chair is not occupied, and to maintain the seat assembly level when occupied. Opposed roll bias springs are preferably connected with the roll pivot means to urge the yoke assembly and chair assembly toward a normal attitude, and are adapted to exert such force as to maintain the chair assembly in normal attitude when the chair is unoccupied, and have such resilience as to permit the seat assembly to remain level when occupied.

DESCRIPTION OF THE PREFERRED EMBODIMENT

Figure 1:
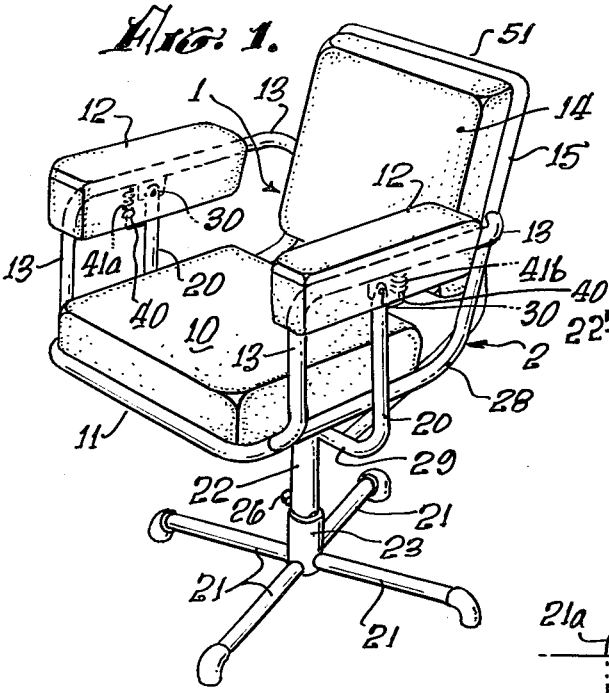
FIG. 1 is a perspective view of a stabilized oscillating chair apparatus according to the invention.
Figure 2:
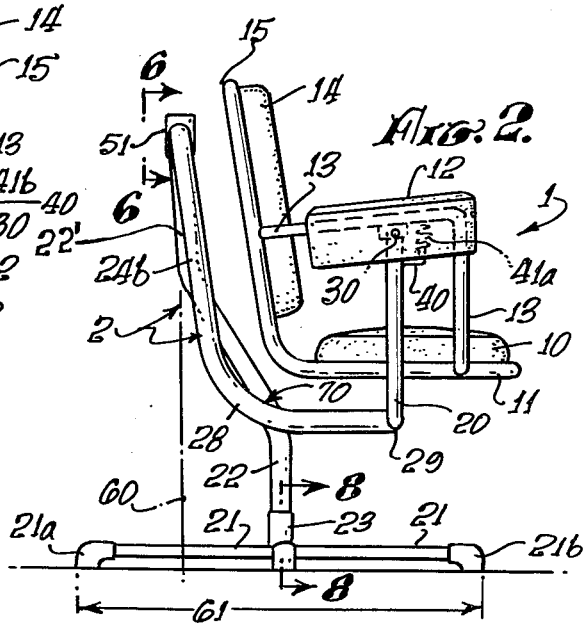
FIG. 2 is a side elevational view of the chair assembly of FIG. 1.
Figure 3:
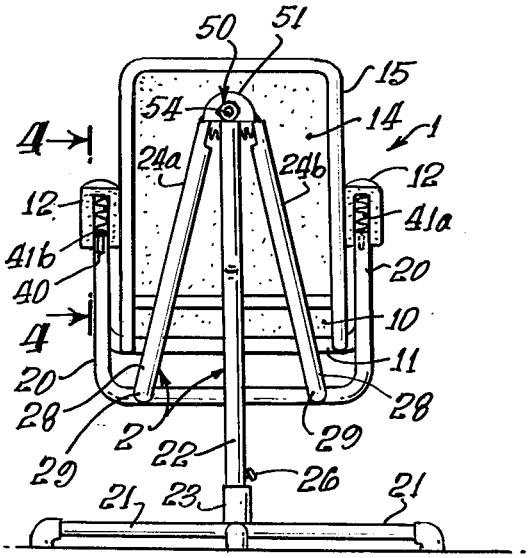
FIG. 3 is a rear view of the chair apparatus of FIGS. 1 and 2.

Referring to FIGS. 1 to 3, the stabilized oscillating chair of the invention is shown as comprising a seat assembly 1 and a yoke assembly 2. The seat assembly 1 has a seat portion 10, a pair of arm rests 12, 12 and a tubular frame work having seat element 11, arm elements 13, 13, and back element 15.

Referring to FIGS. 1 to 3, pitch pivots 30, 30 are provided under the frame arm elements 13, 13, by which the chair assembly 1 is mounted for pitch rotation, the pitch pivots 30, 30 permitting the chair assembly to swing forward and backward relative to the yoke.

The yoke assembly 2 comprises a U-shaped member or portion 20 which extends under the chair assembly, as indicated at 29 in FIGS. 1 and 3, and which has rearwardly and upwardly extending portions 70 which support the pitch pivots 30, 30. The yoke assembly 2 which is typically a unitary welded structure, is supported at the top portion of a column 22 by interconnecting members **24*a*, 24*b* of the yoke assembly, which converge in an inverted V configuration, and which are secured, as by welding, to a cap element 51, best shown in FIG. 6, pivoted at 50 to the top portion of column 22**, thus providing a roll pivot to pivotally mount the yoke assembly for roll rotation.

Column 22 is supported by a base 21, which has outwardly extending feet of welded tubing or pipe, as shown. A pivot bearing portion 23 of the base receives the column for swiveling or yaw rotation. Swivel lock means 26 are provided, and is hereinafter described relative to FIG. 8.

As shown in FIG. 2, column 22 has a bent configuration and a rearwardly extending portion 22', offset approximately 10 to 20 cm, so that the center of gravity of the chair assembly 1 is positioned over base 21.

Figure 4:
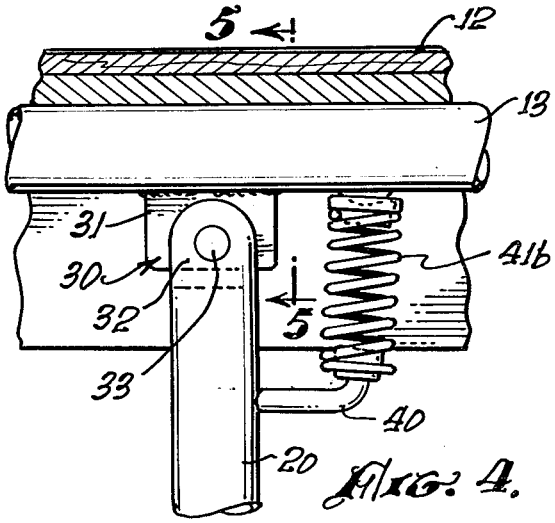
FIG. 4 is an enlarged fragmentary view, taken at line 4—4 of FIG. 3.
Figure 5:
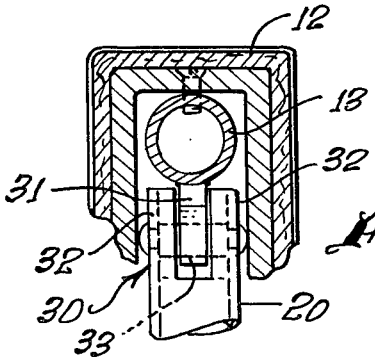
FIG. 5 is a sectional view taken at line 5—5 of FIG. 4.

As shown in FIGS. 3 and 4, bias springs **41*a*, 41*b* are provided under each of the arms 12. The pitch pivots are preferably of lug-and-clevis construction, each comprising a lug 31 welded on the underside of arm frame element 13 and fitting into a clevis 32 on an end portion on one of support elements 20 of yoke assembly 2, a pivot pin 33** extending through both elements.

Bias springs **41*a*, 41*b* are mounted adjacent to each pitch pivot 30, by means of brackets 40 which extend from supporting elements 20 of the yoke assembly, one spring being provided forward of pivot 30 on the right-hand arm, and the other spring rearward of the pivot on the left-hand arm, or vice-versa. One spring biases the chair to tip backwardly, and the other forwardly. Each of the springs is preferably preloaded resiliently to urge the chair assembly 1 toward a normal or horizontal attitude. It will be understood that other bias spring arrangements may be utilized. Thus, leaf springs may be employed, and a pair of bias springs may be utilized for each pitch pivot 30**, one for biasing in the forward direction and one for biasing in the rearward direction. The springs may be preloaded either in compression or in tension.

Figure 6:
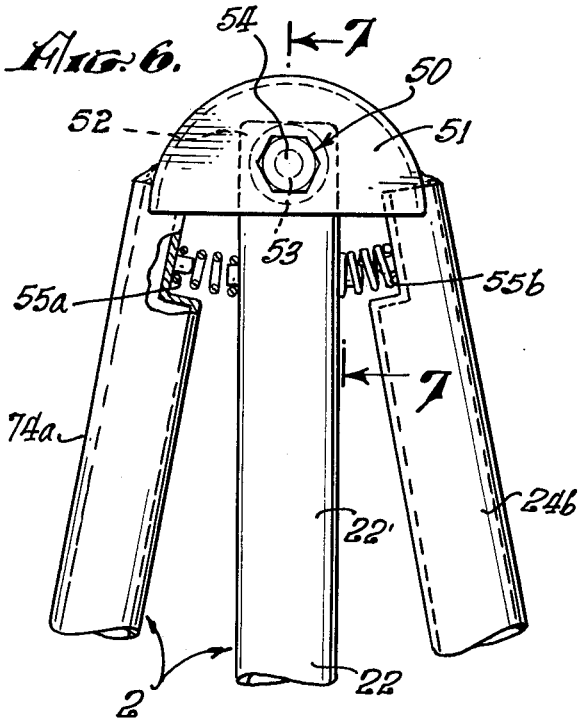
FIG. 6 is an enlarged partial view, taken at line 6—6 in FIG. 2.
Figure 7:
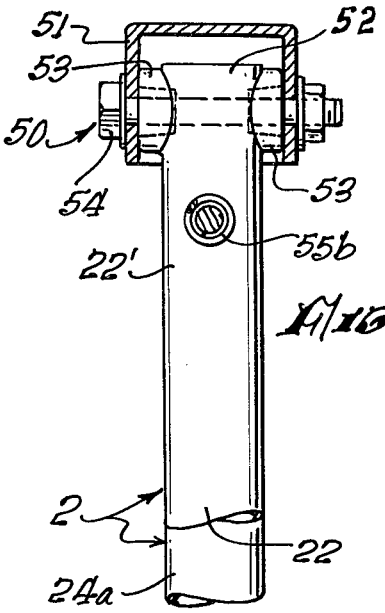
FIG. 7 is a sectional view taken at line 7—7 of FIG. 6.

Referring to FIGS. 6 and 7, preloaded bias springs 55*a*, 55*b* are provided at each side of the roll pivot 50 which comprises an eye portion 52 atop column 22 and a cap 51 to which the upper end portions of interconnecting members 24*a*, 24*b* are secured, as by welding. The eye 52 has a conical bore in which conical bushings 53, 53 are mounted. A securing bolt 54 extends through the assembly. The bias springs resiliently urge the yoke assembly toward a central or normal position. Each of the bias springs is adapted to exert sufficient force to maintain the chair assembly in a normal attitude when unoccupied, yet to permit relative rotation when the chair is occupied, while exerting force to reduce relative rotation.

Roll pivot 50 is positioned substantially higher than the pitch pivots 30, 30, thus to effect when the chair is occupied, a lower frequency of angular oscillation in roll rotations and in pitch rotation, thus providing a "pendulum effect" favorable to the comfort of the occupant.

Each of the interconnecting members 24*a*, 24*b* has a bent configuration and an upper and an upper rearwardly extending portion 28 positioned to engage column 22 to limit the roll rotation of the yoke assembly and chair assemblies.

Figure 8:
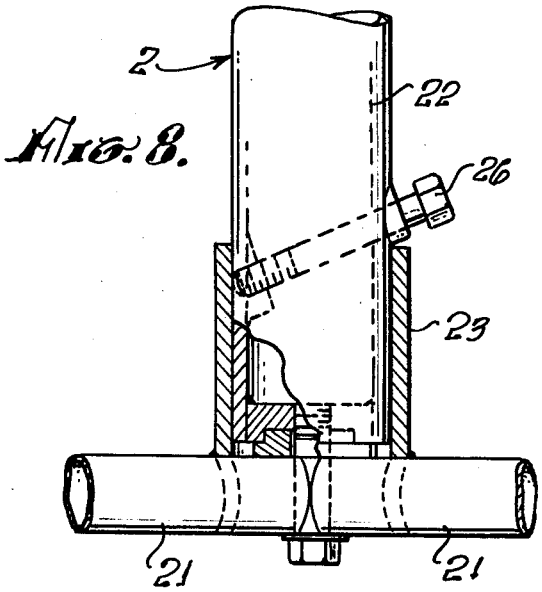
FIG. 8 is an enlarged partial sectional view, taken at line 8—8 in FIG. 2.

A swivel or pivot bearing for column 22 is provided on base 21, and comprises a pivot or swivel socket 23 into which the lower end portion of the column is received. A locking or securing screw 26 is threadably mounted in the column, as shown in FIG. 8, and is engageable with the socket 23 to secure the column in a selected position.

Figure 9:
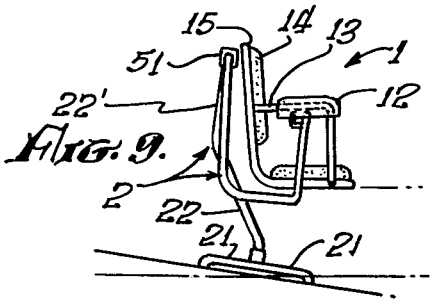
FIGS. 9 to 11 are diagrammatic views illustrating the compensation by the stabilized oscillating chair of the invention for pitch and roll movement of a supporting base, such as a boat.
Figure 10:
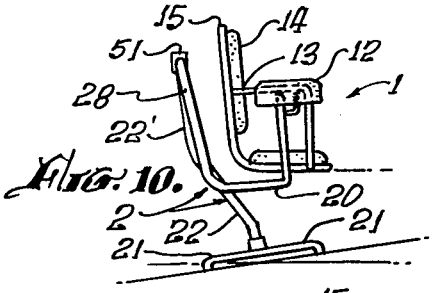
Figure 11:
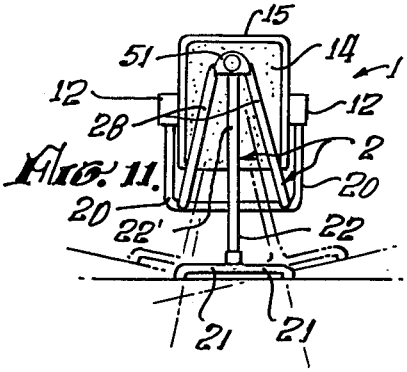

FIGS. 9 to 11 are semi-diagrammatic views showing different rotational positions of the yoke assembly and chair assembly. FIG. 9 shows the chair assembly 1 pivoted rearwardly about its pitch pivots to accommodate the forward pitch of the base 21, as during the pitching of a boat deck, and FIG. 10 shows the chair assembly pivoted forwardly about its pitch pivots to accommodate the upward pitch of base 21. As shown, chair assembly 1 remains substantially level as base 21 undergoes pitch movement.

FIG. 11 illustrates in solid lines and broken lines respectively, starboard and port rolling of base 21, as during rolling movement of a boat deck, while the chair assembly 1 remains substantially level.

It will be appreciated that the stabilized oscillating chair of the invention serves to maintain its chair assembly and an occupant therein, in a substantially level or normal attitude during the roll, pitch, or yaw rotation of a platform on which its base is mounted, as on a boat or other vehicle. The chair of the invention may also serve as a rocking chair or the like.

The inventor claims:

1. A stabilized oscillating chair comprising:

base means, a column extending upwardly from the base, a seat assembly comprising a bottom portion, a back portion and a pair of arm rests, one on either side and above the bottom portion, a yoke assembly supported on the upper end portion of the column for relative roll rotation, said yoke assembly extending under the chair assembly seat portion and upward to engage roll pivot means at the upper end portion of the column, the column being rotatably connected with the base for yaw rotation of the yoke assembly relative to the base, and said yoke assembly having arm portions extending under each of said arm rests and pivotally connected therewith for pitch rotation of the chair assembly.

2. A stabilized oscillating chair according to claim 1, wherein:

said yoke assembly comprises a U-shaped member extending under the chair assembly seat portion and having arm portions extending upwardly on either side thereof and carrying pitch pivots mounting the chair assembly for relative pitch rotation; and said yoke assembly comprising members interconnecting said U-shaped member with roll pivot means at the upper end portion of said column for roll rotation of the chair assembly relative to the base means.

3. A stabilized oscillating chair according to claim 2, wherein:

said column has an upper rearwardly offset portion, and wherein each of said yoke assembly interconnecting members has a mid-portion positioned to engage said column to limit roll rotation of the yoke assembly and chair assembly.

4. A stabilized oscillating chair according to claim 1, wherein:

said column is pivotally mounted relative to the base for relative yaw rotation, and further including locking means for securing the column against rotation relative to the base means.

5. A stabilized oscillating chair according to claim 1, wherein:

roll pivot means are provided at the upper end portion of the column for mounting the yoke assembly for relative roll rotation, and said roll pivot means is approximately at the level of upper portion of the back portion of the chair assembly and at a level substantially above said pitch pivots.

6. A stabilized oscillating chair according to claim 2, and further including:

a pair of opposed pitch bias springs connected with said pitch pivots to resiliently urge said chair assembly to a normal attitude, one of said springs being disposed adjacent one pitch pivot to urge the chair assembly toward forward pitch, and the other of the springs is disposed adjacent the other pitch pivot to urge the chair assembly toward backward pitch.

7. A stabilized oscillating chair according to claim 6, wherein:

each of said bias springs is adapted to exert such biasing force as to maintain the chair assembly in a normal attitude relative to said base when the chair assembly is not occupied, and has sufficient resilience to accommodate maintaining the seat assembly substantially level when occupied.

8. A stabilized oscillating chair according to claim 2, and further including:

a pair of opposed roll bias springs connected with said roll pivotal connection to resiliently urge the yoke assembly and chair assembly toward a normal attitude.

9. A stabilized oscillating chair according to claim 8, wherein:

said roll bias springs are adapted to exert sufficient force to maintain the chair assembly in a normal attitude when the chair assembly is not occupied, and has sufficient resilience to permit the seat assembly to remain substantially level when occupied.

* * * * *